US010591197B2

(12) United States Patent
Schweiger et al.

(10) Patent No.: US 10,591,197 B2
(45) Date of Patent: Mar. 17, 2020

(54) REFRIGERATOR APPLIANCE

(71) Applicant: Haier US Appliance Solutions, Inc., Wilmington, DE (US)

(72) Inventors: Christopher J. Schweiger, Louisville, KY (US); Brent Alden Junge, Evansville, IN (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 118 days.

(21) Appl. No.: 15/784,239

(22) Filed: Oct. 16, 2017

(65) Prior Publication Data

US 2019/0113266 A1 Apr. 18, 2019

(51) Int. Cl.

| | |
|---|---|
| ***B65D 81/38*** | (2006.01) |
| ***F25D 23/06*** | (2006.01) |
| ***F25D 11/02*** | (2006.01) |
| *F25D 23/02* | (2006.01) |

(52) U.S. Cl.

CPC ..... *F25D 11/02* (2013.01); *F25D 23/065* (2013.01); *F25D 23/069* (2013.01); *F25D 23/021* (2013.01)

(58) Field of Classification Search

CPC ..... F25D 23/065; F25D 23/069; F25D 11/02; F25D 25/025

See application file for complete search history.

(56) References Cited

U.S. PATENT DOCUMENTS

| | | | | |
|---|---|---|---|---|
| 3,038,774 | A * | 6/1962 | Cyrus | F25D 25/025 312/350 |
| 7,607,743 | B2 * | 10/2009 | Jang | F25D 23/028 312/404 |
| 9,140,472 | B2 | 9/2015 | Shin et al. | |
| 9,841,224 | B2 * | 12/2017 | Hitzelberger | F25D 23/04 |
| 2006/0130513 | A1 | 6/2006 | Chang et al. | |
| 2006/0138920 | A1 * | 6/2006 | Jang | F25D 23/028 312/405 |
| 2008/0148765 | A1 * | 6/2008 | Barone | F25D 17/06 62/407 |
| 2011/0048059 | A1 * | 3/2011 | Song | F25D 19/006 62/449 |

(Continued)

FOREIGN PATENT DOCUMENTS

EP 0535519 B1 5/1996

*Primary Examiner* — Kimberley S Wright

(74) *Attorney, Agent, or Firm* — Dority & Manning, P.A.

(57) ABSTRACT

A refrigerator appliance includes a cabinet which defines a fresh food storage chamber, a frozen food storage chamber, and a variable food storage chamber positioned between the fresh food storage chamber and the frozen food storage chamber. The refrigerator appliance includes a wall which at least partially defines the variable food storage chamber. The wall includes an outer surface facing an ambient environment around the refrigerator appliance and an inner surface positioned opposite the outer surface. The refrigerator appliance also includes insulation extending between the outer surface of the wall and the variable food storage chamber. The insulation includes a plurality of movable segments. The movable segments are movable between a first position and a second position. A thermal conductivity of the wall is greater when the movable segments are in the second position than when the movable segments are in the first position.

18 Claims, 7 Drawing Sheets

(56) References Cited

U.S. PATENT DOCUMENTS

| | | | | |
|---|---|---|---|---|
| 2011/0248038 | A1* | 10/2011 | Mayer | B65D 81/382<br>220/592.27 |
| 2012/0024003 | A1* | 2/2012 | Kim | F25D 23/126<br>62/389 |
| 2018/0016083 | A1* | 1/2018 | Knight | B65D 81/3816 |
| 2018/0209713 | A1* | 7/2018 | Yun | F25B 21/00 |

* cited by examiner

REFRIGERATOR APPLIANCE

FIELD

The present disclosure relates generally to refrigerator appliances, and more particularly to refrigerator appliances which include compartments for storing items at various temperatures and temperature ranges.

BACKGROUND

Generally, refrigerator appliances include a cabinet that defines a fresh food chamber for receipt of food items for storage. Many refrigerator appliances further include a freezer chamber for receipt of food items for freezing and storage. In many currently utilized refrigerator appliances, the freezer chamber is positioned below the fresh food chamber. Users of these refrigerator appliances must bend over to reach frozen food items stored in the freezer chamber. This can be detrimental and even painful to users with back issues, etc.

Additionally, many such presently known refrigerator appliances do not include areas which allow for storage of food items above the temperature of the fresh food chamber. Such storage areas may be desired for the storage of wine, certain vegetables, etc.

Accordingly, improved refrigerator appliances are desired. For example, refrigerator appliances which provide storage areas that facilitate selective storage of items at freezing temperatures and at higher temperatures including temperatures above the temperature of the fresh food chamber would be advantageous.

BRIEF DESCRIPTION

Additional aspects and advantages of the technology will be set forth in part in the following description, or may be apparent from the description, or may be learned through practice of the technology.

In accordance with one embodiment, a refrigerator appliance is provided. The refrigerator appliance defines a vertical direction, a lateral direction, and a transverse direction. The vertical, lateral, and transverse directions are mutually perpendicular. The refrigerator appliance includes a cabinet which defines a fresh food storage chamber, a frozen food storage chamber, and a variable food storage chamber positioned between the fresh food storage chamber and the frozen food storage chamber. The refrigerator appliance includes a wall which at least partially defines the variable food storage chamber. The wall includes an outer surface facing an ambient environment around the refrigerator appliance and an inner surface positioned opposite the outer surface. The refrigerator appliance also includes insulation extending between the outer surface of the wall and the variable food storage chamber. The insulation includes a plurality of movable segments. The movable segments are movable between a first position and a second position. A thermal conductivity of the wall is greater when the movable segments are in the second position than when the movable segments are in the first position.

In accordance with another embodiment, a variable thermal conductivity food storage container is provided. A compartment is defined within an interior of the variable thermal conductivity food storage container. The variable thermal conductivity food storage container includes a wall which at least partially defines the compartment. The wall includes an outer surface facing an ambient environment around the variable thermal conductivity food storage container and an inner surface positioned opposite the outer surface. The variable thermal conductivity food storage container also includes insulation extending between the outer surface of the wall and the compartment. The insulation includes a plurality of movable segments. The movable segments are movable between a first position and a second position. A thermal conductivity of the wall is greater when the movable segments are in the second position than when the movable segments are in the first position.

These and other features, aspects and advantages of the present technology will become better understood with reference to the following description and appended claims. The accompanying drawings, which are incorporated in and constitute a part of this specification, illustrate embodiments of the technology and, together with the description, serve to explain the principles of the technology.

BRIEF DESCRIPTION OF THE DRAWINGS

A full and enabling disclosure of the present technology, including the best mode thereof, directed to one of ordinary skill in the art, is set forth in the specification, which makes reference to the appended figures, in which.

DETAILED DESCRIPTION

Figure 1:
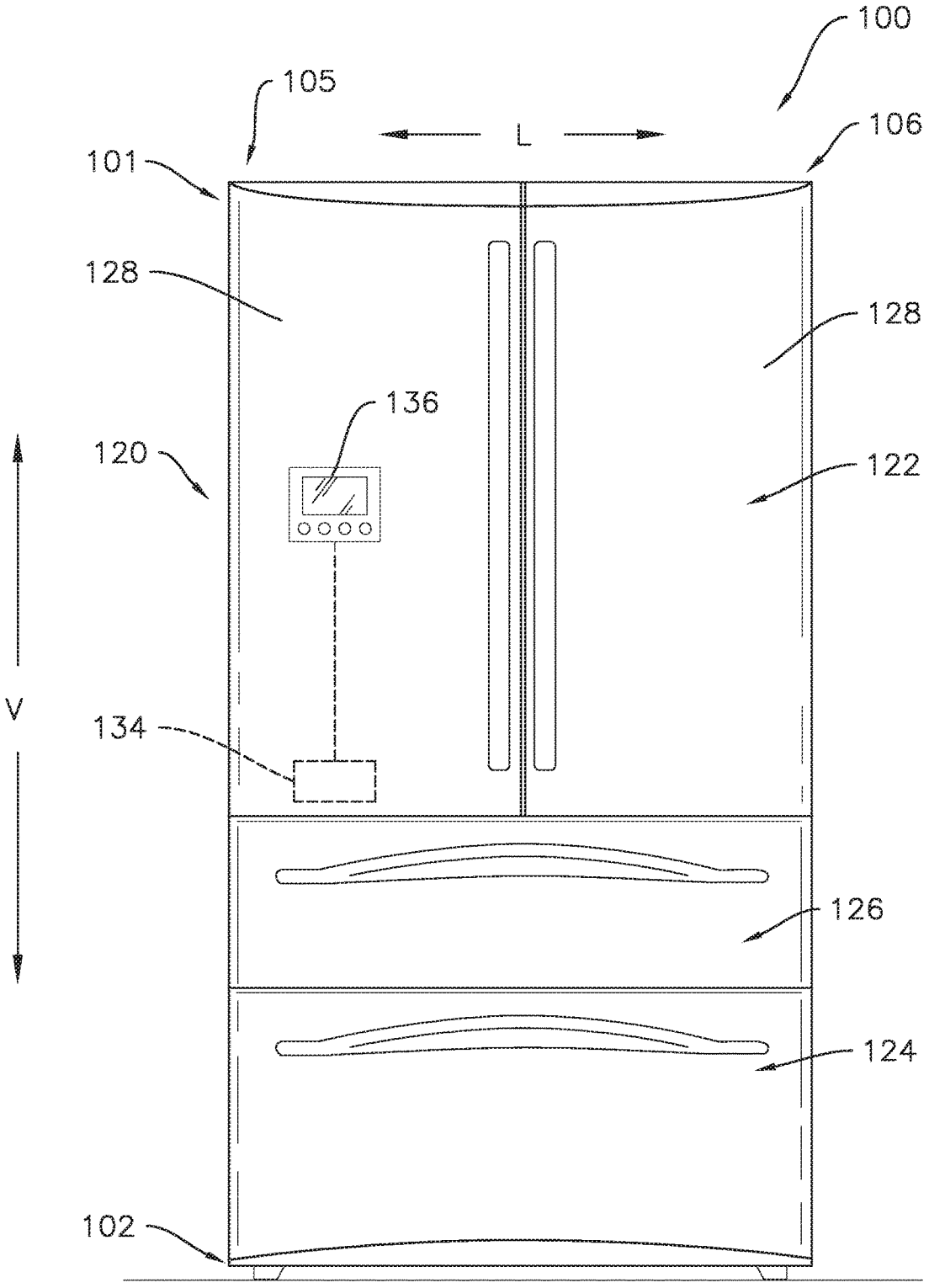
FIG. 1 provides a front view of a refrigerator appliance according to one or more exemplary embodiments of the present subject matter.

Reference now will be made in detail to embodiments of the technology, one or more examples of which are illustrated in the drawings. Each example is provided by way of explanation of the technology, not limitation of the technology. In fact, it will be apparent to those skilled in the art that various modifications and variations can be made in the present technology without departing from the scope or spirit of the technology. For instance, features illustrated or described as part of one embodiment can be used with another embodiment to yield a still further embodiment. Thus, it is intended that the present technology covers such modifications and variations as come within the scope of the appended claims and their equivalents.

Figure 2:
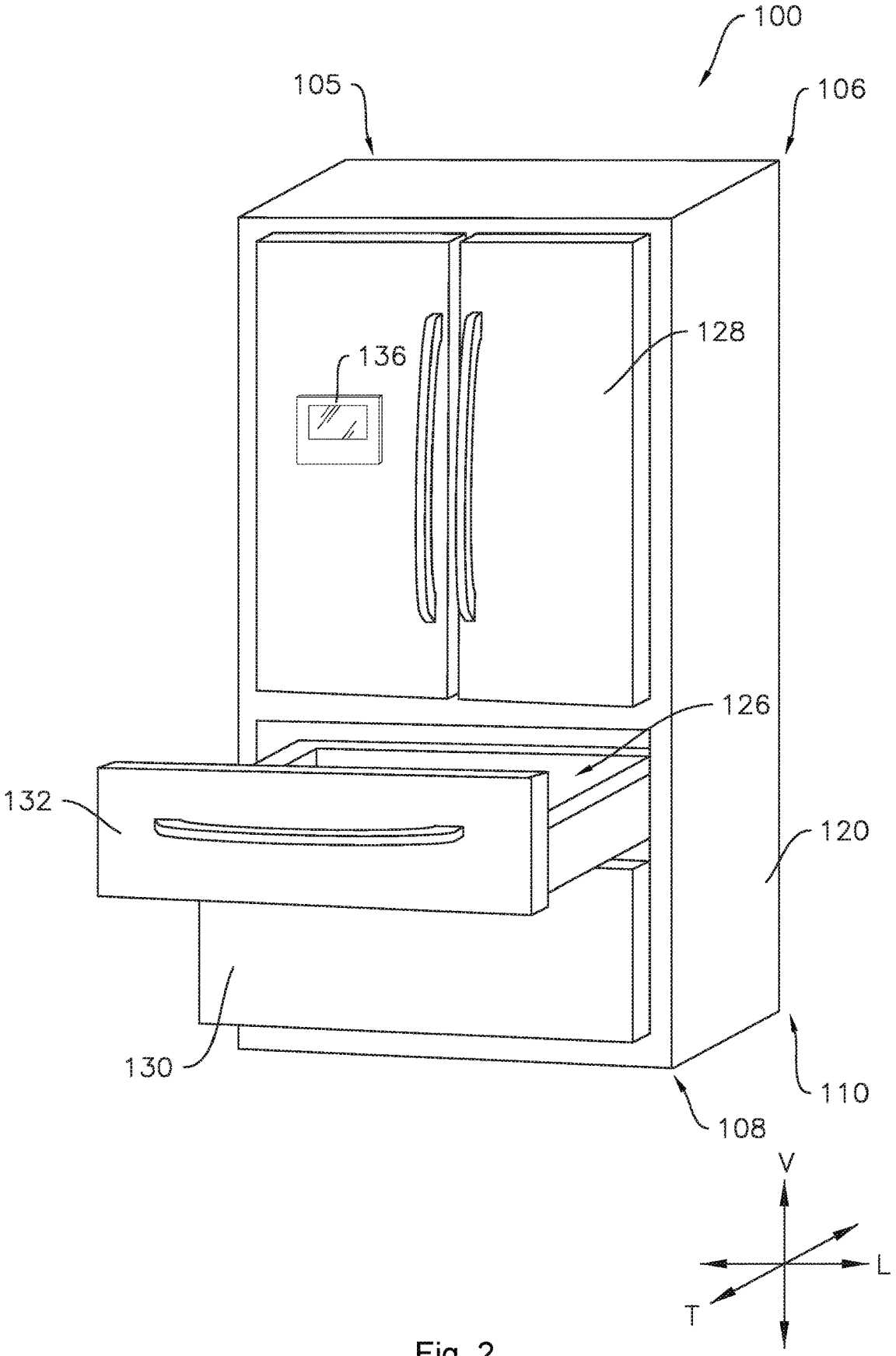
FIG. 2 provides a perspective view of the refrigerator appliance of FIG. 1 with a door of a variable food storage chamber in an open position.

FIG. 1 is a front view of an exemplary embodiment of a refrigerator appliance 100. FIG. 2 is a perspective view of the refrigerator appliance 100 having a door 132 of a variable food storage chamber 126 in an open position to reveal the interior of the variable food storage chamber 126. Refrigerator appliance 100 extends between a top 101 and a bottom 102 along a vertical direction V. Refrigerator appliance 100 also extends between a first side 105 and a second side 106 along a lateral direction L. As shown in FIG. 2, a transverse direction T may additionally be defined perpendicular to the vertical and lateral directions V, L. Refrigerator appliance 100 extends along the transverse direction T between a front portion 108 and a back portion 110.

Refrigerator appliance 100 includes a cabinet or housing 120 defining an upper fresh food chamber 122 and a lower freezer chamber or frozen food storage chamber 124 arranged below the fresh food chamber 122 along the vertical direction V. The variable food storage chamber 126 is positioned between the fresh food storage chamber 122 and the frozen food storage chamber, e.g., along the vertical direction V. Because the frozen food storage chamber 124 is positioned below the fresh food storage chamber 122, refrigerator appliance 100 is generally referred to as a bottom mount refrigerator. In the exemplary embodiment, housing 120 also defines a mechanical compartment (not shown) for receipt of a sealed cooling system (not shown). Using the teachings disclosed herein, one of skill in the art will understand that the present technology can be used with other types of refrigerators (e.g., side-by-sides) or a freezer appliance as well. Consequently, the description set forth herein is for illustrative purposes only and is not intended to limit the technology in any aspect.

Refrigerator doors 128 are rotatably hinged to an edge of housing 120 for accessing fresh food chamber 122. It should be noted that while two doors 128 in a "french door" configuration are illustrated, any suitable arrangement of doors utilizing one, two or more doors is within the scope and spirit of the present disclosure. A freezer door 130 is arranged below refrigerator doors 128 for accessing freezer chamber 124. In the exemplary embodiment, freezer door 130 is coupled to a freezer drawer (not shown) slidably coupled within freezer chamber 124.

Operation of the refrigerator appliance 100 can be regulated by a controller 134 that is operatively coupled to a user interface panel 136. Panel 136 provides selections for user manipulation of the operation of refrigerator appliance 100 such as e.g., temperature selections, including those discussed herein, etc. In response to user manipulation of the user interface panel 136, the controller 134 operates various components of the refrigerator appliance 100. The controller may include a memory and one or more microprocessors, CPUs or the like, such as general or special purpose microprocessors operable to execute programming instructions or micro-control code associated with operation of refrigerator appliance 100. The memory may represent random access memory such as DRAM, or read only memory such as ROM or FLASH. In one embodiment, the processor executes programming instructions stored in memory. The memory may be a separate component from the processor or may be included onboard within the processor.

The controller 134 may be positioned in a variety of locations throughout refrigerator appliance 100. In the illustrated embodiment, the controller 134 may be located within the door 128. In such an embodiment, input/output ("I/O") signals may be routed between the controller and various operational components of refrigerator appliance 100. In one embodiment, the user interface panel 136 may represent a general purpose I/O ("GPIO") device or functional block. In one embodiment, the user interface 136 may include input components, such as one or more of a variety of electrical, mechanical or electro-mechanical input devices including rotary dials, push buttons, and touch pads. The user interface 136 may include a display component, such as a digital or analog display device designed to provide operational feedback to a user. The user interface 136 may be in communication with the controller via one or more signal lines or shared communication busses.

Figure 3:
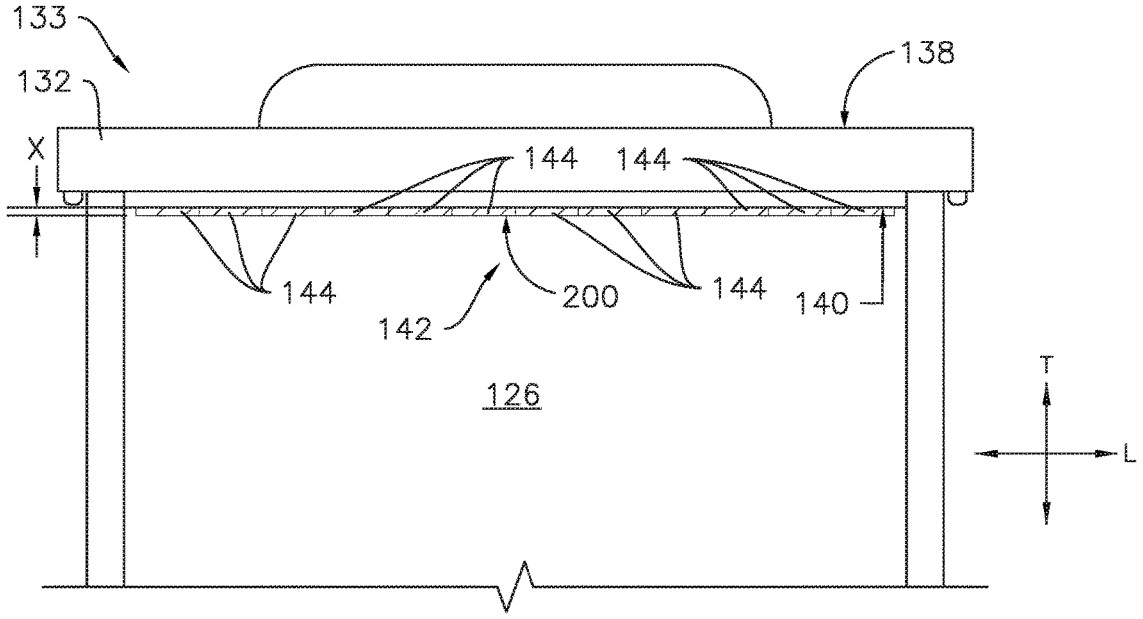
FIG. 3 provides a section view of an exemplary variable thermal conductivity food storage container according to one or more exemplary embodiments of the present subject matter with movable segments of insulation in a first position.
Figure 4:
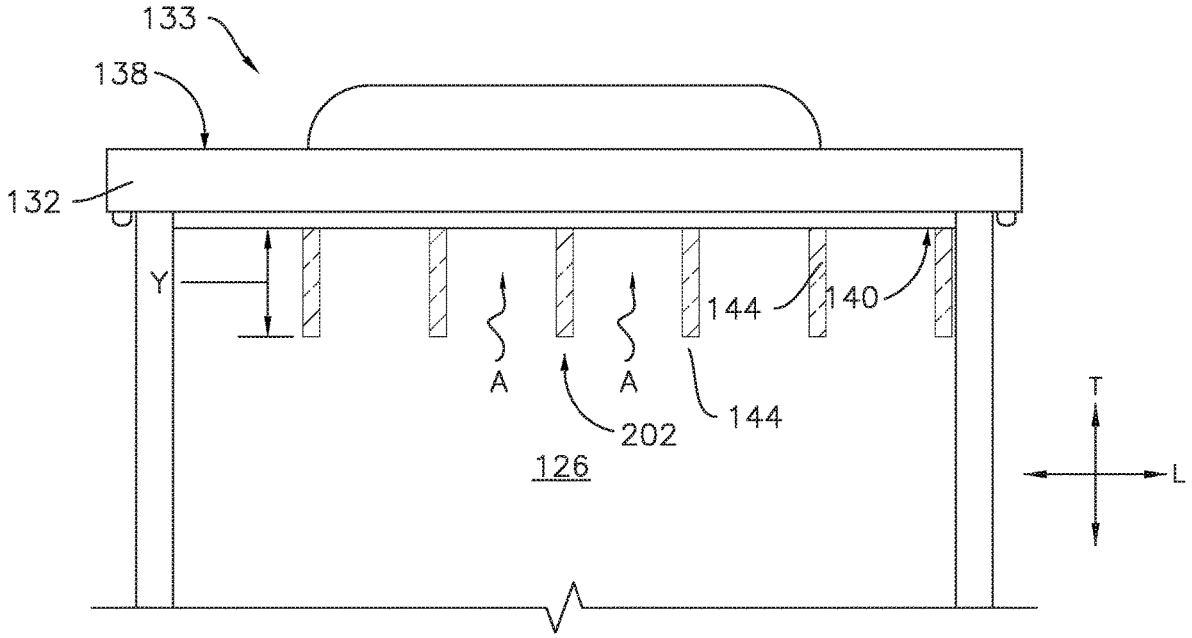
FIG. 4 provides a section view of the variable thermal conductivity food storage container of FIG. 3 with the movable segments of insulation in a second position.

FIGS. 3 and 4 illustrate one example embodiment of a variable thermal conductivity food storage container defining a compartment therein, in the example illustrated the variable thermal conductivity food storage container is a drawer 133 of refrigerator appliance 100 and the compartment defined therein is variable food storage chamber 126. In various embodiments, the variable food storage chamber 126 is at least partially defined by a wall. For example, in the illustrated embodiments of FIGS. 3 and 4, door 132 provides the wall which partially defines the variable food storage chamber 126. As illustrated, the door 132 (which is an embodiment of the wall) includes an outer surface 138 facing an ambient environment around the refrigerator appliance 100 and an inner surface 140 positioned opposite the outer surface 138. The variable thermal conductivity food storage container, e.g., variable food storage chamber 126 also includes insulation 142 extending between the outer surface 138 of the wall 132 and the variable food storage chamber 126. The insulation 142 includes a plurality of movable segments 144. As illustrated for example in FIGS. 3 and 4, the movable segments 144 are movable between a first position (FIG. 3) and a second position (FIG. 4), wherein a thermal conductivity of the wall 132 is greater when the movable segments 144 are in the second position than when the movable segments 144 are in the first position. The wall, including the insulation 142 and the plurality of movable segments 144, provides an insulated barrier where the effective thickness of the insulation 142 may be selectively adjusted. For example, as illustrated in FIG. 4, air A from within the variable food storage chamber 126 may be separated from the ambient environment by the reduced effective thickness of the insulation 142 when the movable segments 144 are in the second position such that thermal energy may be more easily transferred between the variable food storage chamber 126 and the ambient environment.

Figure 5:
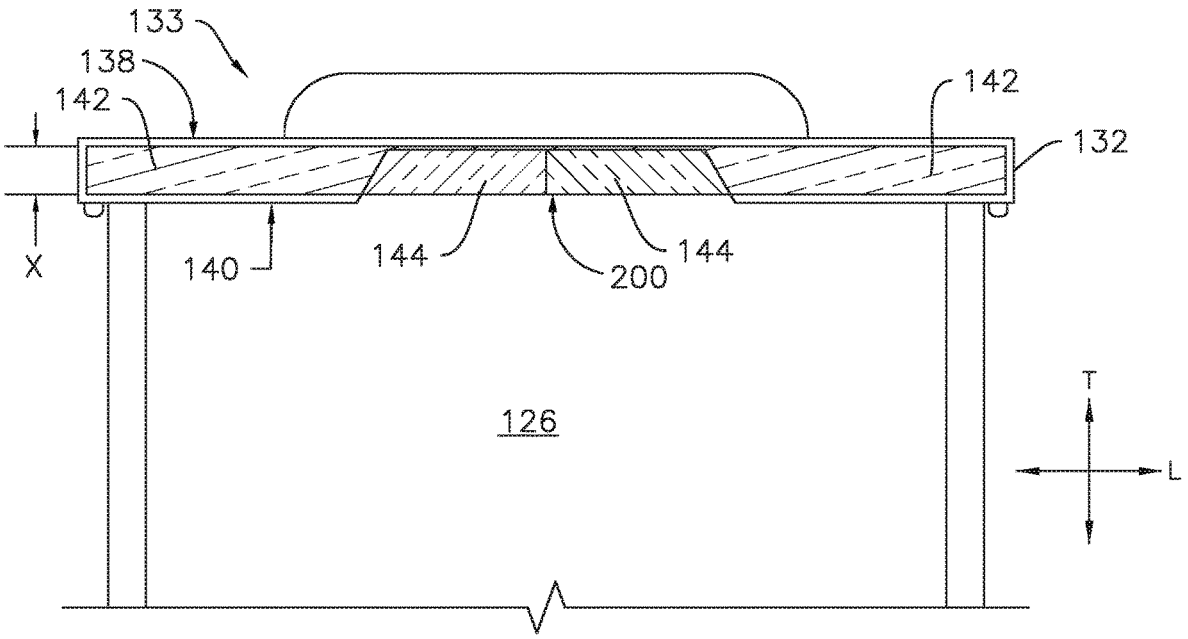
FIG. 5 provides a section view of an exemplary variable thermal conductivity food storage container according to one or more exemplary embodiments of the present subject matter with movable segments of insulation in a first position.
Figure 6:
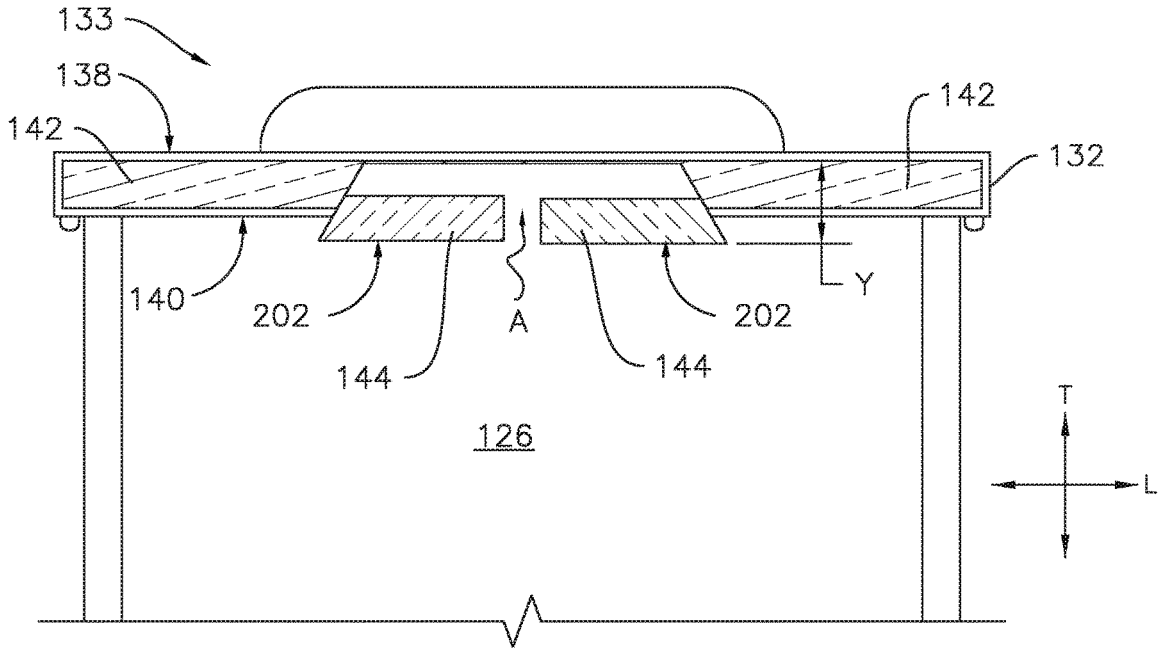
FIG. 6 provides a section view of the variable thermal conductivity food storage container of FIG. 5 with the movable segments of insulation in a second position.

In some embodiments, the movable segments 144 of the insulation 142 define a continuous surface 200 along a direction parallel to the outer surface 138 of the wall, e.g., door 132, when the movable segments are in the first position, and the movable segments 144 of the insulation 142 define a discontinuous surface 202 along the direction parallel to the outer surface 138 of the wall, e.g., door 132, when the movable segments 144 are in the second position. For example, as shown in FIG. 3, the continuous surface 200 may be defined by a first side of each of the movable segments 144, and, as shown in FIG. 4, the discontinuous surface 202 may be defined by a second side of each of the movable segments 144. In another example, as shown in FIGS. 5 and 6, the continuous surface 200 and the discontinuous surface 202 may both be defined by the same side of each of the movable segments 144. As shown in FIGS. 4 and 6, the discontinuous surface 202 allows air A from within the variable food storage chamber 126 to bypass the insulation 142 via one or more gaps or discontinuities.

As shown in FIG. 3, the insulation 142 defines a uniform thickness X along a direction perpendicular to the outer surface 138 of the wall when the movable segments 144 are in the first position. As shown in FIG. 4, the insulation 142 defines a non-uniform thickness Y along the direction perpendicular to the outer surface 138 of the wall when the movable segments 144 are in the second position. For example, in FIG. 4, the thickness Y of the insulation 142 is greater than zero at the position indicated, but the thickness Y is zero in areas between the movable segments 144.

The variable food storage chamber 126 may be selectively operable over a range of temperatures, including temperatures below and above freezing. In exemplary embodiments, the variable food storage chamber 126 thus facilitates use with both frozen foods, etc. at below-freezing temperatures, as well as food items such as wines, vegetables, etc. which require above-freezing temperatures which, in some cases, may even be above the temperature of the fresh food chamber 122. For example, in some embodiments, the variable food storage chamber 126 may be configured to provide any desired storage temperature between about zero degrees Fahrenheit (0° F.) and about fifty degrees Fahrenheit (50° F.), such as between about ten degrees Fahrenheit (10° F.) and about forty-two degrees Fahrenheit (42° F.). As used herein, terms of approximation such as "generally," "about," or "approximately" include values within ten percent greater or less than the stated value. For example, "about 100° F." includes from 90° F. to 110° F. In such embodiments, it may at times be desirable to effect a relatively rapid increase in the temperature within the variable food storage chamber 126. For example, the variable food storage chamber 126 may at a first time be set to a low temperature, such as about 0° F., and may then at a second or later time be adjusted to a relatively high temperature, which may even be a warmer temperature than the temperature of the fresh food storage chamber 122. For example, the fresh food storage chamber 122 may provide a temperature of about 37° F. and the variable food storage chamber 126 may selectively provide a temperature of about 45° F. Continuing the example, when the variable food storage chamber 126 is adjusted from about 0° F. to about 45° F., the movable segments 144 of the insulation 142 may be moved to the second position to provide increased thermal conductivity through the door 132 and more rapid warming of the variable food storage chamber 126 as thermal energy may be more easily gained from the ambient environment when the movable segments 144 of the insulation 142 are in the second position. Accordingly, the variable food storage chamber 126 may more quickly and efficiently adjust the storage temperature provided, e.g., without the use of a heat source such as an electrical resistive heater.

The change or variation in the thermal conductivity may be provided by several possible configurations of the wall, e.g., door 132, and the insulation 142. In some example embodiments, e.g., as illustrated in FIGS. 3 and 4, the plurality of movable segments 144 may be rotatable between the first position and the second position by approximately ninety degrees about the vertical direction. Also as illustrated in FIGS. 3 and 4, in some embodiments, the plurality of movable segments 144 may be parallel to the wall, e.g., door 132 and in particular the outer surface 138 thereof, in the first position and perpendicular to the wall in the second position. In additional example embodiments, e.g., as illustrated in FIGS. 5 through 8, the plurality of movable segments 144 may be translatable between the first position and the second position along a direction oblique to the wall. In additional example embodiments, e.g., as illustrated in FIGS. 9 through 12, the plurality of movable segments 144 may be translatable between the first position and the second position along a direction perpendicular to the wall. In some embodiments, the insulation 142 may be disposed on the inner surface 140 of the wall and may extend from the inner surface 140 of the wall towards the compartment, e.g., variable food storage chamber 126, away from the outer surface 138 of the wall, e.g., as shown in FIGS. 3 and 4. In other embodiments, the insulation 142 may be disposed between the outer surface 138 of the wall and the inner surface 140 of the wall, e.g., as shown in FIGS. 5 through 12. As illustrated, e.g., in FIGS. 6, 8, 10, and 12, at least a portion of the insulation 142 may advantageously remain in position between the outer surface 138 and the food storage chamber 126 across the entirety of the outer surface 138 when the movable segments 144 are in the second position to minimize condensation or "sweating" while also providing increased thermal conductivity.

As noted above, the variable food storage chamber 126 may be operable at a variety of temperatures. For example, a temperature set point of the variable food storage chamber 126 may be entered by a user via a user input device, such as user interface panel 136. In some embodiments, e.g., as illustrated in FIGS. 7 through 10, the variable food storage chamber 126 may include one or more manual actuators 146 in operative communication with the plurality of movable segments 144 of the insulation 142. For example, the manual actuators 146 may include a button 148 which slides along and within a track 150. In embodiments including the one or more manual actuators 146, the user may manipulate the manual actuator(s), e.g., by sliding the button 148 within the track 150, to move the plurality of movable segments 144 of the insulation 142 between the first position and the second position. In some embodiments, the controller 134 may be configured to provide a text message or other prompt or indicator, such as via the user interface panel 136, to remind the user to adjust the position of the movable segments 144. Such prompts may be provided when the temperature set point is adjusted and/or when a sensed temperature within the variable food storage chamber 126 reaches or is within a close range of the temperature set point. For example, if the initial set point is 0° F., the subsequent set point is 42° F., and an ambient temperature is about 70° F., it may be advantageous to return the movable segments 144 to the first position when the sensed temperature is at or about 42° F. in order to avoid or minimize overshooting the set point.

In additional embodiments, the controller 134 may be in operative communication with one or more electromechanical actuators 152 (FIG. 12), and the electromechanical actuators 152 may be in operative communication with the plurality of movable segments 144 of the insulation 142. In such embodiments, the controller 134 may be configured to operate the electromechanical actuators 152 to selectively increase or decrease the thermal conductivity of the door 132 in response to a user-selected temperature set point. For example, where an initial or first set point may be relatively low, e.g., about 0° F., and a second or subsequent set point may the relatively high, e.g., about 42° F., the controller 134 may, in response to the increased set point, operate the electromechanical actuators 152 to move the plurality of movable segments 144 to the second position. As another example, the controller 134 may be configured to operate the electromechanical actuators 152 to move the plurality of movable segments 144 from the second position to the first position in response to a decrease in the temperature set point.

Figure 7:
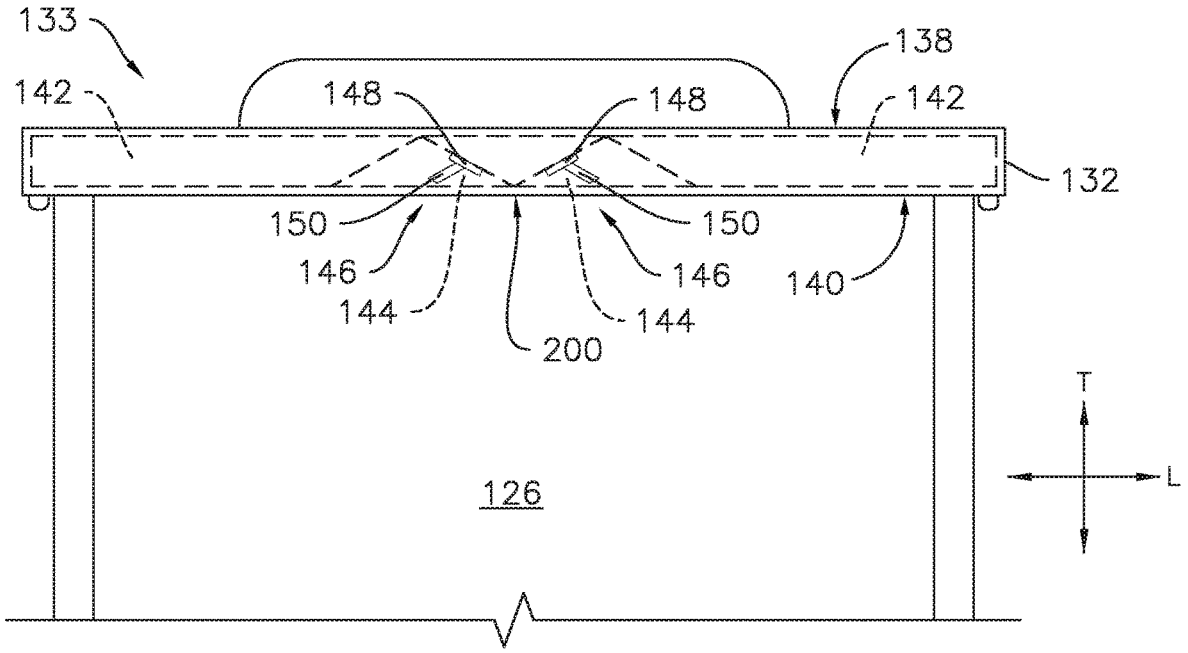
FIG. 7 provides a top view of an exemplary variable thermal conductivity food storage container according to one or more exemplary embodiments of the present subject matter with movable segments of insulation in a first position.
Figure 8:
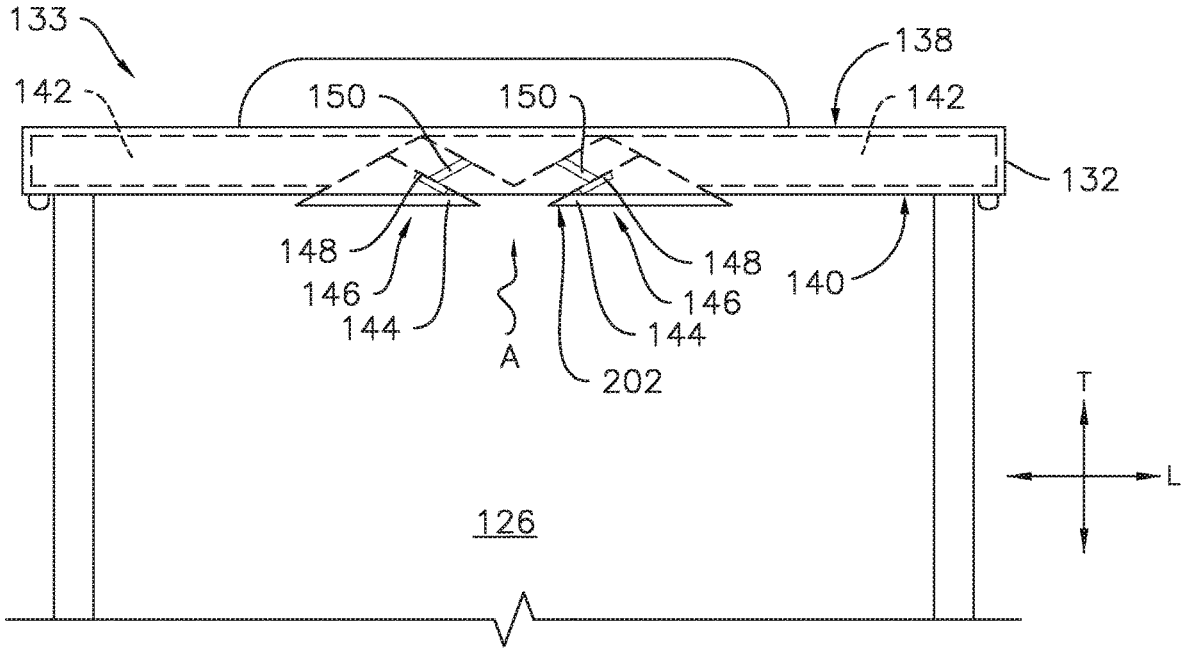
FIG. 8 provides a top view of the variable thermal conductivity food storage container of FIG. 7 with the movable segments of insulation in a second position.
Figure 9:
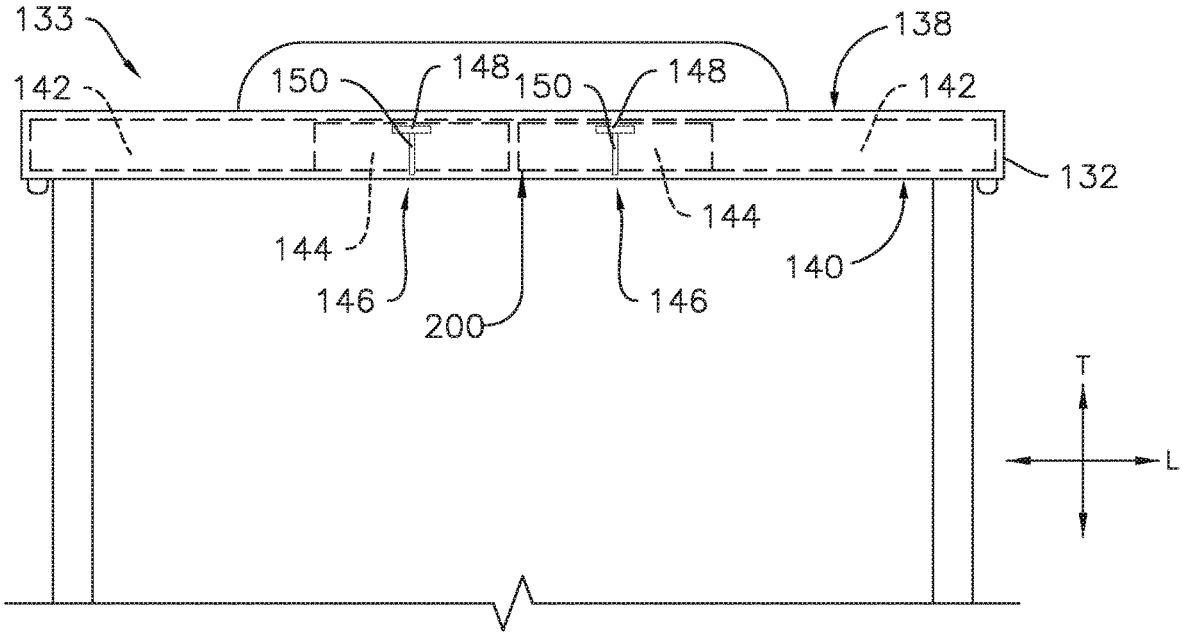
FIG. 9 provides a top view of an exemplary variable thermal conductivity food storage container according to one or more exemplary embodiments of the present subject matter with movable segments of insulation in a first position.
Figure 10:
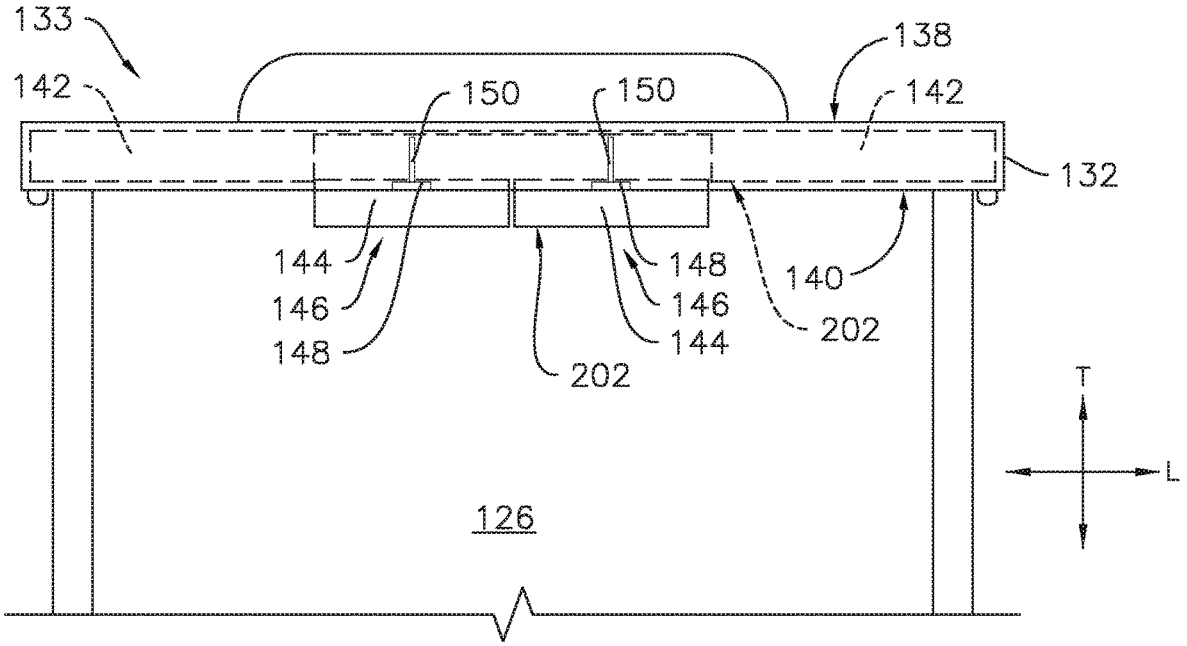
FIG. 10 provides a top view of the variable thermal conductivity food storage container of FIG. 9 with the movable segments of insulation in a second position.
Figure 11:
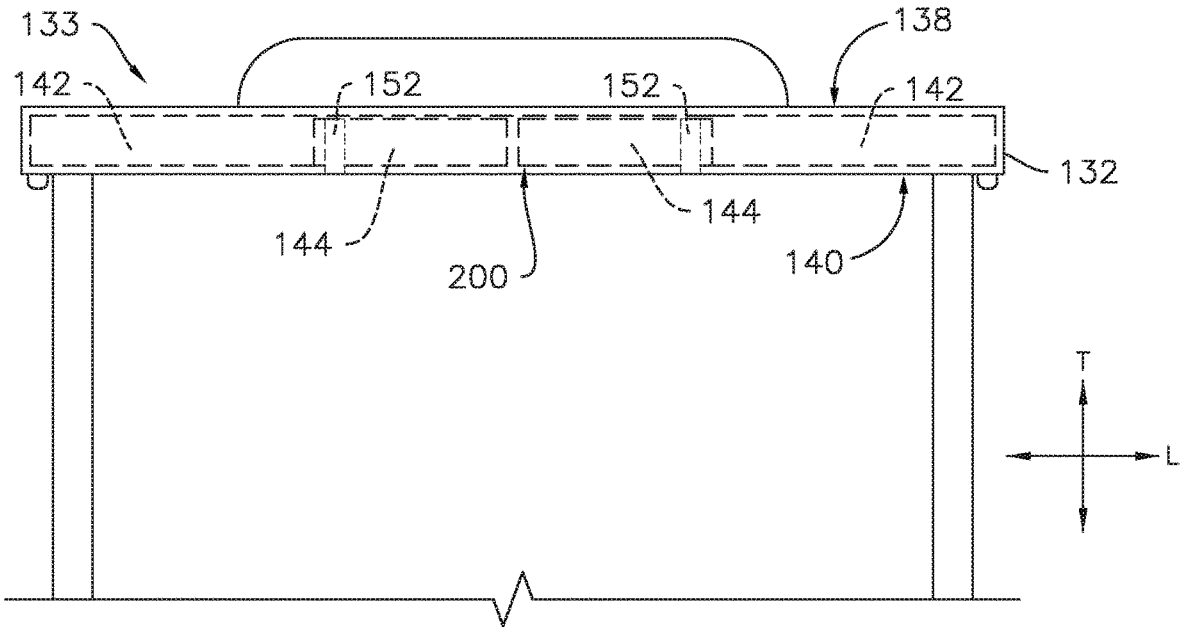
FIG. 11 provides a top view of an exemplary variable thermal conductivity food storage container according to one or more exemplary embodiments of the present subject matter with movable segments of insulation in a first position.
Figure 12:
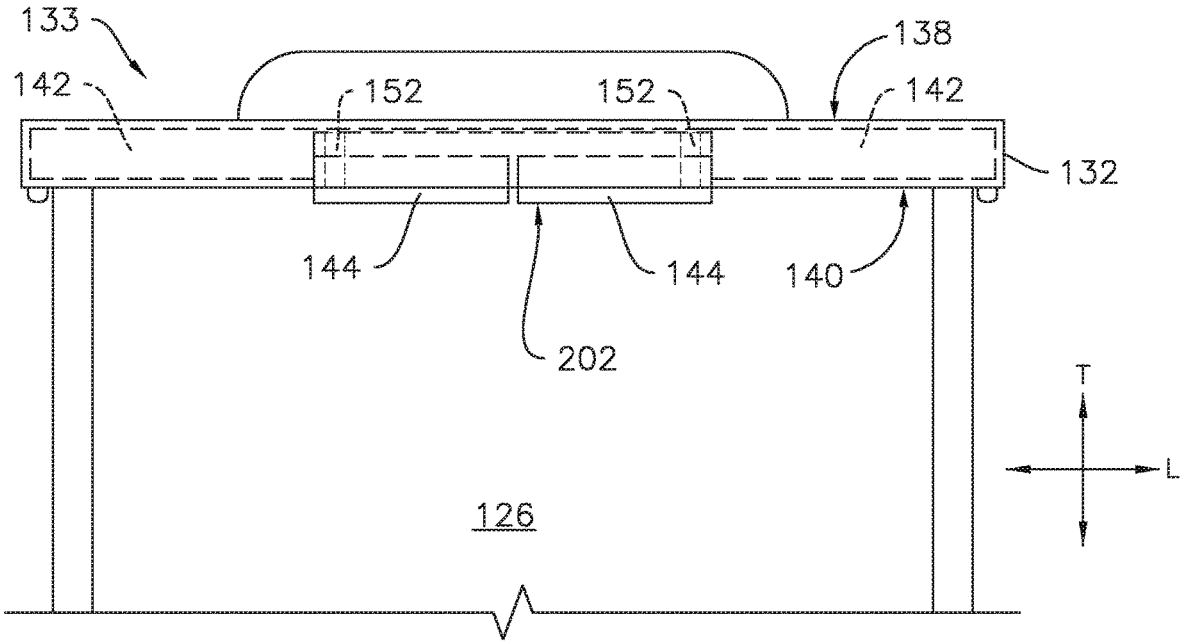
FIG. 12 provides a top view of the variable thermal conductivity food storage container of FIG. 7 with the movable segments of insulation in a second position.

Additional possible configurations of the wall, e.g., door 132, and the insulation 142 to provide the change or variation in the thermal conductivity may include variations in the shape of the plurality of movable segments 144. For example, in some embodiments, each movable segment 144 of the plurality of movable segments 144 of the insulation 142 may be rectangular, e.g., as illustrated in FIGS. 3, 4, and 9 through 12. As another example, in additional embodiments, the plurality of movable segments 144 may be two movable segments 144 which collectively form a trapezoid, e.g., as illustrated in FIGS. 5 and 6. As a further example, in additional embodiments, each movable segment 144 of the plurality of movable segments 144 of the insulation 142 may be triangular, e.g., as illustrated in FIGS. 7 and 8.

This written description uses examples to disclose the technology, including the best mode, and also to enable any person skilled in the art to practice the technology, including making and using any devices or systems and performing any incorporated methods. The patentable scope of the technology is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A refrigerator appliance, defining a vertical direction, a lateral direction, and a transverse direction, the vertical, lateral, and transverse directions being mutually perpendicular, the refrigerator appliance comprising:

a cabinet defining a fresh food storage chamber, a frozen food storage chamber, and a variable food storage chamber positioned between the fresh food storage chamber and the frozen food storage chamber;

a wall at least partially defining the variable food storage chamber, the wall comprising an outer surface facing an ambient environment around the refrigerator appliance and an inner surface positioned opposite the outer surface; and insulation extending between the outer surface of the wall and the variable food storage chamber, the insulation comprising a plurality of movable segments, the movable segments movable between a first position and a second position, wherein a thermal conductivity of the wall is greater when the movable segments are in the second position than when the movable segments are in the first position;

wherein the plurality of movable segments of the insulation define a continuous surface along a direction parallel to the outer surface of the wall when the plurality of movable segments are in the first position and the plurality of movable segments of the insulation define a discontinuous surface along the direction parallel to the outer surface of the wall when the plurality of movable segments are in the second position.

2. The refrigerator appliance of claim 1, wherein the insulation defines a uniform thickness along a direction perpendicular to the outer surface of the wall when the plurality of movable segments are in the first position and the insulation defines a non-uniform thickness along the direction perpendicular to the outer surface of the wall when the plurality of movable segments are in the second position.

3. The refrigerator appliance of claim 1, wherein the plurality of movable segments are rotatable between the first position and the second position by approximately ninety degrees about the vertical direction.

4. The refrigerator appliance of claim 1, wherein the plurality of movable segments are translatable between the first position and the second position along a direction oblique to the wall.

5. The refrigerator appliance of claim 1, wherein the plurality of movable segments are translatable between the first position and the second position along a direction perpendicular to the wall.

6. A variable thermal conductivity food storage container, comprising:

a compartment defined within an interior of the variable thermal conductivity food storage container;

a wall at least partially defining the compartment, the wall comprising an outer surface facing an ambient environment around the variable thermal conductivity food storage container and an inner surface positioned opposite the outer surface; and insulation extending between the outer surface of the wall and the compartment, the insulation comprising a plurality of movable segments, the movable segments movable between a first position and a second position, wherein a thermal conductivity of the wall is greater when the movable segments are in the second position than when the movable segments are in the first position;

wherein the plurality of movable segments of the insulation define a continuous surface along a direction parallel to the outer surface of the wall when the plurality of movable segments are in the first position and the plurality of movable segments of the insulation define a discontinuous surface along the direction parallel to the outer surface of the wall when the plurality of movable segments are in the second position.

7. The variable thermal conductivity food storage container of claim 6, wherein the insulation defines a uniform thickness along a direction perpendicular to the outer surface of the wall when the plurality of movable segments are in the first position and the insulation defines a non-uniform thickness along the direction perpendicular to the outer surface of the wall when the plurality of movable segments are in the second position.

8. The variable thermal conductivity food storage container of claim 6, wherein the insulation is disposed between the outer surface of the wall and the inner surface of the wall.

9. The variable thermal conductivity food storage container of claim 6, wherein the insulation is disposed on the inner surface of the wall and extends from the inner surface of the wall towards the compartment away from the outer surface of the wall.

10. The variable thermal conductivity food storage container of claim 6, further comprising a manual actuator in operative communication with the plurality of movable segments of the insulation.

11. The variable thermal conductivity food storage container of claim 6, further comprising an electromechanical actuator in operative communication with the plurality of movable segments of the insulation.

12. The variable thermal conductivity food storage container of claim 6, wherein each movable segment of the plurality of movable segments of the insulation is triangular.

13. The variable thermal conductivity food storage container of claim 6, wherein each movable segment of the plurality of movable segments of the insulation is rectangular.

14. The variable thermal conductivity food storage container of claim 6, wherein the plurality of movable segments comprises two movable segments, the two movable segments collectively forming a trapezoid.

15. The variable thermal conductivity food storage container of claim 6, wherein the plurality of movable segments are parallel to the wall in the first position and perpendicular to the wall in the second position.

16. The variable thermal conductivity food storage container of claim 6, wherein the plurality of movable segments are rotatable between the first position and the second position by approximately ninety degrees about a vertical axis.

17. The variable thermal conductivity food storage container of claim 6, wherein the plurality of movable segments are translatable between the first position and the second position along a direction oblique to the wall.

18. The variable thermal conductivity food storage container of claim 6, wherein the plurality of movable segments are translatable between the first position and the second position along a direction perpendicular to the wall.

* * * * *